US009604461B2

(12) United States Patent
Kobayashi

(10) Patent No.: US 9,604,461 B2
(45) Date of Patent: Mar. 28, 2017

(54) PRINTING DEVICE

(71) Applicant: BROTHER KOGYO KABUSHIKI KAISHA, Nagoya-shi, Aichi (JP)

(72) Inventor: Haruo Kobayashi, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 15/042,851

(22) Filed: Feb. 12, 2016

(65) Prior Publication Data

US 2016/0243832 A1 Aug. 25, 2016

(30) Foreign Application Priority Data

Feb. 20, 2015 (JP) ..... 2015-031882

(51) Int. Cl.
*B41J 2/165* (2006.01)

(52) U.S. Cl.
CPC ..... *B41J 2/16523* (2013.01); *B41J 2/16505* (2013.01); *B41J 2/16508* (2013.01); *B41J 2/16511* (2013.01); *B41J 2/16517* (2013.01)

(58) Field of Classification Search
CPC B41J 2/16505; B41J 2/16517; B41J 2/16523; B41J 2/16511; B41J 2/165
See application file for complete search history.

(56) References Cited

U.S. PATENT DOCUMENTS 6,273,546 B1 * 8/2001 Kobayashi ..... B41J 2/16547 347/29
6,918,650 B2 * 7/2005 Umeda ..... B41J 2/16508 347/29
2007/0097170 A1 * 5/2007 Sekiya ..... B41J 2/16508 347/30
2012/0242741 A1 * 9/2012 Hasegawa ..... C09D 11/324 347/20
2014/0184713 A1 * 7/2014 Murakami ..... B41J 11/08 347/104

FOREIGN PATENT DOCUMENTS

JP 2007-290174 A 11/2007

* cited by examiner

*Primary Examiner* — Manish S Shah
*Assistant Examiner* — Yaovi M Ameh
(74) *Attorney, Agent, or Firm* — Fox Rothschild LLP

(57) ABSTRACT

A printing device includes a head portion, a receptacle portion, an absorption member, a discharge outlet, and a plurality of extended wall portions. The head portion includes a nozzle face having a nozzle. The absorption member is supported by the receptacle portion, is provided to absorb the liquid, and has a through-hole. The through-hole extends through the absorption member between a first face and a second face in an orthogonal direction to the nozzle face. The first face is an opposite side to the second face. The second face faces the nozzle face in the orthogonal direction. The discharge outlet is provided in a bottom wall portion of the receptacle portion and is continuous with an outside of the receptacle portion. The bottom wall portion extends along the nozzle face. The extended wall portions project from the bottom wall portion to the nozzle face side and support the first face.

19 Claims, 8 Drawing Sheets

PRINTING DEVICE

CROSS-REFERENCE TO RELATED APPLICATION

This application claims priority to Japanese Patent Application No. 2015-031882 filed on Feb. 20, 2015, the disclosure of which is herein incorporated by reference in its entirety.

BACKGROUND

The present disclosure relates to a printing device that is provided with a receptacle in which an absorption member is disposed.

A printing device is known that is provided with an absorption member that absorbs and discharges waste ink. This type of printing device is provided with a waste ink absorption body. The waste ink absorption body is formed from a foam body. It is preferable that the waste ink absorption body has both the absorbency to absorb the waste ink and the ability to discharge the waste ink.

SUMMARY

A through hole may be formed in the waste ink absorption body. However, the through hole in the waste ink absorption body is easily closed if the foam body has elasticity. Thus, the through hole becomes narrow, and in some cases, the waste ink is not sufficiently discharged from the waste ink absorption body. It is therefore possible that the ink that has not been discharged will harden and bind to the waste ink absorption body, diminishing the absorbency of the waste ink absorption body and its ability to discharge the waste ink. Therefore, the possibility exists that the waste ink absorption body will need to be replaced more frequently.

Various embodiments of the general principles described herein provide a printing device that improves the ability of the waste ink absorption body to absorb and discharge a liquid.

Embodiments herein provide a printing device including a head portion, a receptacle portion, an absorption member, a discharge outlet, and a plurality of extended wall portions. The head portion includes a nozzle face. The nozzle face has a nozzle to discharge a liquid. The receptacle portion is provided facing the nozzle face. The absorption member is supported by the receptacle portion. The absorption member is provided facing the nozzle face. The absorption member is provided to absorb the liquid. The absorption member is provided with a through-hole. The through-hole extends through the absorption member, in an orthogonal direction to the nozzle face, between a first face and a second face of the absorption member. The first face is an opposite side to the second face. The second face faces the nozzle face in the orthogonal direction. The discharge outlet is provided in a bottom wall portion of the receptacle portion. The bottom wall portion extends along the nozzle face. The discharge outlet is continuous with an outside of the receptacle portion. The plurality of extended wall portions project from the bottom wall portion to the nozzle face side and support the first face of the absorption member.

BRIEF DESCRIPTION OF THE DRAWINGS

Embodiments will be described below in detail with reference to the accompanying drawings in which.

DETAILED DESCRIPTION

The configuration of a printer 1 will be explained with reference to FIGS. 1 to 8. The top side, the bottom side, the lower left side, the upper right side, the lower right side, and the upper left side in FIG. 1 respectively indicate the top side, the bottom side, the front side, the rear side, the right side, and the left side of the printer 1. Furthermore, in some cases, the front-rear direction, in which a platen 5 that will be described later conveys a print medium by a platen drive mechanism 6, will be called the conveyance direction.

Figure 1:
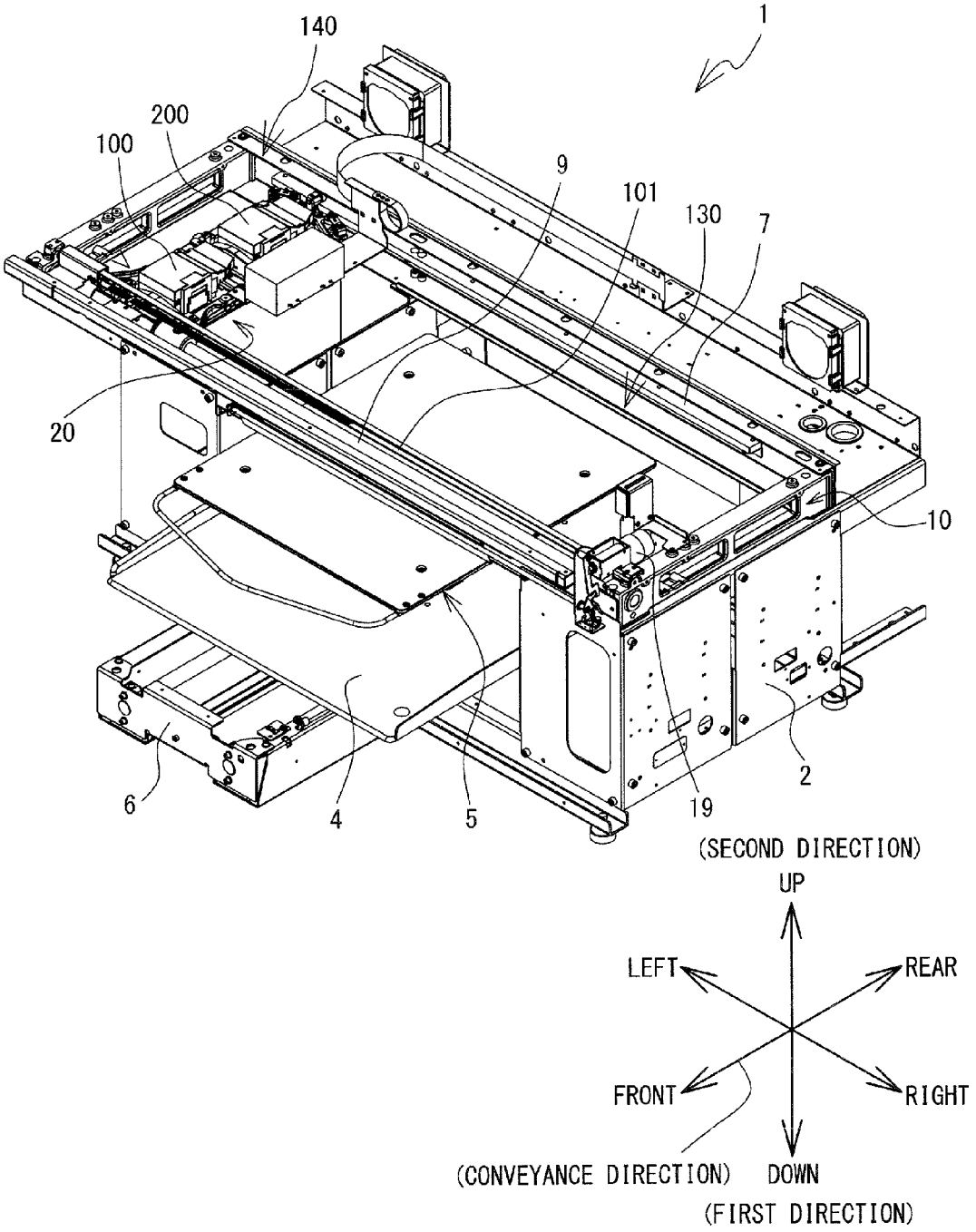
FIG. 1 is an oblique view of a printer.

As shown in FIG. 1, the printer 1 is an inkjet printer that, by discharging a liquid ink, performs printing on a cloth (not shown in the drawings), such as a T-shirt or the like, that is the print medium. The printer 1 may also use paper or the like as the print medium. The printer 1 is able to print a color image on the print medium by discharging five different types of the ink (white (W), black (K), yellow (Y), cyan (C), and magenta (M)) downward. In the explanation that follows, of the five types of the ink, the white ink will be called the white ink, and the four colored inks, black, cyan, yellow, and magenta, will be collectively called the color inks. Each of the inks is made from a solvent that is either water or an organic solvent, plus a colored pigment or dye. An ink is known that contains an adhesive resin emulsion. The resin emulsion is included in the ink as a dispersant for the pigment, for example, or as a binder that fixes the pigment to the cloth. In the present embodiment, as an example, the resin emulsion is included in the white ink and in the color inks.

The printer 1 is provided with a housing 2, the platen drive mechanism 6, a pair of guide rails (not shown in the drawings), the platen 5, a tray 4, a frame body 10, a guide shaft 9, a rail 7, a carriage 20, head units 100, 200, a drive belt 101, and a drive motor 19.

The housing 2 is substantially a three-dimensional rectangle whose long axis extends in the left-right direction. An operation portion (not shown in the drawings) that performs operations of the printer 1 is provided in a position on the right front side of the housing 2. The operation portion is provided with a display and an operation button. The display displays various types of information. The operation button is operated when a user inputs commands that are related to various types of operations of the printer 1.

The frame body 10 has a frame shape and is substantially rectangular in a plan view. The frame body 10 is installed in the top portion of the housing 2. The front side of the frame body 10 supports the guide shaft 9, and the rear side of the frame body 10 supports the rail 7. The guide shaft 9 is a shaft member and extends in the left-right direction inside the frame body 10. The rail 7 is a rod-like member that extends in the left-right direction, and is disposed facing the guide shaft 9.

Figure 4:
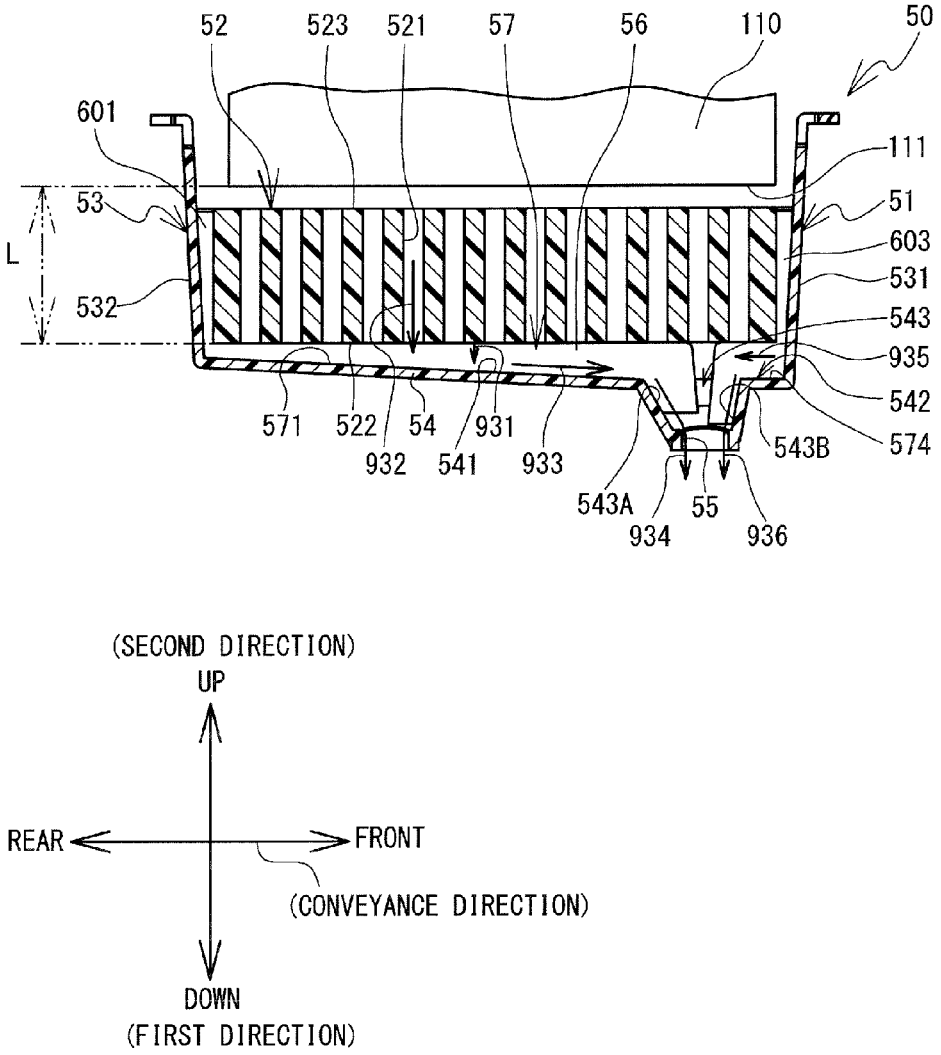
FIG. 4 is a section view along a line IV-IV in FIG. 3.

The carriage 20 is supported such that it can be conveyed in the left-right direction along the guide shaft 9. The head units 100, 200 are carried on the carriage 20 and are arrayed in the front-rear direction. The head unit 100 is located in front of the head unit 200. As shown in FIG. 4, a head 110 is provided on the bottom of each one of the head units 100, 200. That is, a plurality of the heads 110 on the head units 100, 200 are arrayed in the conveyance direction. A nozzle face 111 that is flat and parallel to the horizontal plane is formed on the bottom face of the each of the heads 110. A plurality of tiny nozzles are provided in the nozzle face 111 that are able to discharge one of the white ink and the color inks downward.

As shown in FIG. 1, the drive belt 101 has a belt shape and spans the inner side of the frame body 10 in the left-right direction. The drive belt 101 is made of a flexible resin. The drive motor 19 is provided in the front right portion of the inner side of the frame body 10. The drive motor 19 is capable of rotating forward and in reverse, and is coupled to the carriage 20 through the drive belt 101. When the drive motor 19 drives the drive belt 101, the carriage 20 is moved reciprocally to the left and the right along the guide shaft 9. The head units 100, 200 are thus moved reciprocally to the left and the right. The head units 100, 200 discharge the inks toward the print medium that is supported by the platen 5, which is disposed below the head units 100, 200 such that it faces the head units 100, 200. At this time, the platen drive mechanism 6 conveys the platen 5 in the conveyance direction. The platen 5 is parallel to the horizontal plane.

The platen drive mechanism 6 is provided with a pair of guide rails (not shown in the drawings) and a platen support base (not shown in the drawings). The pair of the guide rails extend from the front to the rear on the inner side of the platen drive mechanism 6 and support the platen support base such that the platen support base can move in the conveyance direction. The top portion of the platen support base supports the platen 5. The platen 5 supports the print medium.

The tray 4 is provided below the platen 5. When the user places a T-shirt or the like on the platen 5, the tray 4 receives the sleeves and the like of the T-shirt. The sleeves and the like are thus protected, such that they do not come into contact with other parts in the interior of the housing 2.

The platen drive mechanism 6, using as its drive source a motor (not shown in the drawings) that is provided to the rear of the platen drive mechanism 6, moves the platen support base and the platen 5 in the conveyance direction along the pair of the guide rails. As the platen 5 conveys the print medium in the conveyance direction, the heads 110 discharge the inks as they move reciprocally in the left-right direction. The printing is thus performed on the print medium by the printer 1. Note that the conveyance direction is a sub scanning direction, and the left-right direction is a main scanning direction that is orthogonal to the sub scanning direction.

As shown in FIG. 1, the carriage 20 is disposed on the inner side of the frame body 10. Therefore, the heads 110 move in the left-right direction between the left end and the right end of the inner side of the frame body 10. Along the path that the heads 110 travel, the area where the printing is performed by the heads 110 will be called the printing area 130. The area along the path that the heads 110 travel that is not in the printing area 130 will be called the non-printing area 140. The non-printing area 140 is an area in the left portion of the printer 1. The printing area 130 is the area from the right edge of the non-printing area 140 to the right end of the printer 1. The platen 5, the tray 4, and the like are provided in the printing area 130.

Various types of maintenance operations for ensuring printing quality are performed in the non-printing area 140. For example, the maintenance operations include a flushing operation, an ink purge operation, a first wiping operation, a second wiping operation, and the like. The flushing operation is an operation in which, before printing is performed on the print medium, the heads 110 discharge the inks onto flushing units 50 (refer to FIG. 2) that will be described later. The performing of the flushing operation makes it possible for the inks to be discharged appropriately from the heads 110, even right after the printing starts. The ink purge operation is an operation in which the nozzle faces 111 are covered by nozzle caps 144 (refer to FIG. 2) that will be described later and the inks are sucked out of the nozzles by suction devices (not shown in the drawings) that are connected to the nozzle caps 144. The performing of the ink purge operation discharges from the nozzles, along with the ink, any air bubbles that have gotten inside the nozzles, so the possibility can be reduced that an ink discharge problem will be caused by the air bubbles in the heads 110.

The first wiping operation is an operation that uses wipers 31 that will be described later to wipe off excess ink that is remaining on the surfaces of the nozzle faces 111. The performing of the first wiping operation can reduce the possibility that the ink that is remaining on nozzle faces 111 will harden and bind to the nozzle faces 111, making it difficult to discharge the inks from the nozzle faces 111. The second wiping operation is an operation in which ink that is adhering to the wipers 31 is wiped off by absorption members 148 (refer to FIG. 2) that will be described later. The performing of the second wiping operation can reduce the possibility that the ink that is remaining on the wipers 31 will be removed from the wipers 31 and adhere to the nozzle faces 111 the next time that the first wiping operation is performed.

Figure 2:
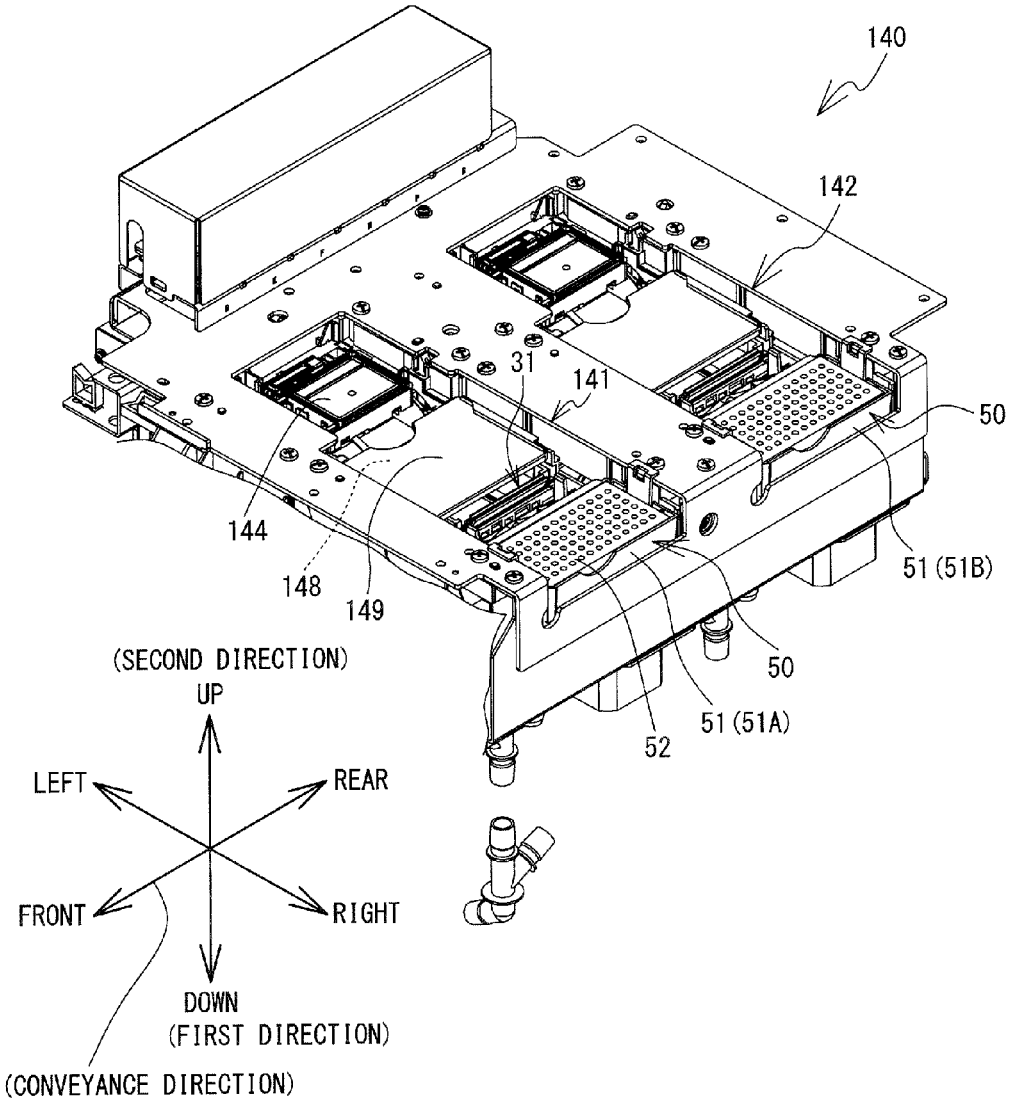
FIG. 2 is an oblique view of a non-printing area.

As shown in FIG. 2, the non-printing area 140 is provided with maintenance portions 141, 142. The maintenance portions 141, 142 are respectively positioned below the travel paths of the head units 100, 200 (refer to FIG. 1). The maintenance operations are performed on the head units 100, 200 in the maintenance portions 141, 142, respectively, under the control of a CPU (not shown in the drawings) of the printer 1. The configurations of the maintenance portions 141, 142 are substantially the same. Accordingly, in the explanation that follows, the maintenance portion 141 will be explained.

The maintenance portion 141 is provided with the wiper 31, the nozzle cap 144, the flushing unit 50, and a support plate 149. The nozzle cap 144 is provided in the left portion of the maintenance portion 141. The nozzle cap 144 has a rectangular shape in a plan view, and the top side of the nozzle cap 144 is open. The nozzle cap 144 is able to move up and down. In a state in which the head unit 100 has moved over the nozzle cap 144, the nozzle cap 144 moves upward and covers the nozzle face 111. In this state, the ink purge operation is performed for the head unit 100. The ink that accumulates in the nozzle cap 144 is discharged into a tank (not shown in the drawings) through a discharge channel that is not shown in the drawings.

The flushing unit 50 is provided in the right portion of the maintenance portion 141. The flushing unit 50 receives the ink that has been discharged from the head unit 100 by the flushing operation. The flushing unit 50 will be described in detail later.

The wiper 31 is provided to the left of the flushing unit 50. The wiper 31 is able to move up and down. In a state in which the wiper 31 has moved to its highest position, the moving of the carriage 20 in the left-right direction causes the wiper 31 to slide along the nozzle face 111, such that the ink is removed from the nozzle face 111. That is, the first wiping operation is performed.

The support plate 149 is provided between the wiper 31 and the nozzle cap 144 in the left-right direction. The support plate 149 is a plate-shaped member that has a rectangular shape in a plan view, and it extends horizontally. The absorption member 148 is stuck to the bottom face of the support plate 149 and is supported by the support plate 149.

The support plate 149 is moved to the left and the right by a drive mechanism that is not shown in the drawings. The wiper 31 thus slides on the bottom face of the absorption member 148, and the ink that has adhered to the wiper 31 is removed. That is, the second wiping operation is performed. The absorption member 148 absorbs the ink that has adhered to the absorption member 148.

Figure 3:
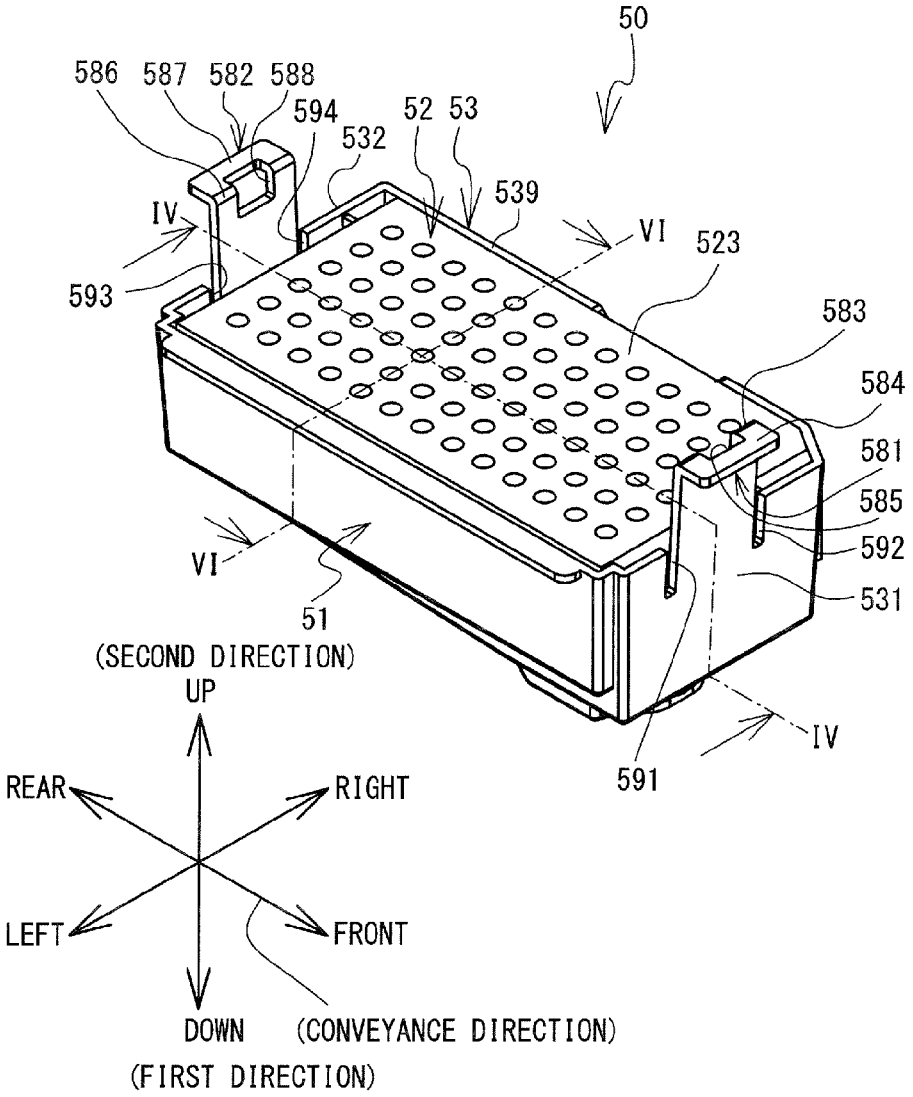
FIG. 3 is an oblique view of a flushing unit.

The flushing unit 50 will be explained. In the explanation that follows, the downward direction, which is the direction of the force of gravity, will sometimes be called the first direction, and the upward direction, which is the opposite of the direction of the force of gravity, will sometimes be called the second direction. As shown in FIG. 3, the flushing unit 50 is provided with a receptacle 51 and an absorption member 52. The receptacle 51 has a rectangular shape in a plan view, with its long axis extending in the front-rear direction, and the top side of the receptacle 51 is open. The receptacle 51 can be mounted in and removed from the printer 1. The absorption member 52 is a three-dimensional rectangular member that can absorb the ink, and it is supported by the receptacle 51. The head 110 can move over the flushing unit 50 (refer to FIGS. 4 and 6). The receptacle 51 and the absorption member 52 face the nozzle face 111 in the up-down direction (refer to FIGS. 4 and 6).

The absorption member 52 can absorb the ink and is formed, for example, from a sponge that is a foam body. The absorption member 52 can be mounted in and removed from the receptacle 51. The absorption member 52 is provided with a plurality of tubes 521. In a plan view, the tubes 521 are arrayed in 6 rows in the left-right direction and in 13 rows in the front-rear direction. As shown in FIG. 4, the tubes 521 extend through the absorption member 52 in the first direction. The face on the first direction side of the absorption member 52 will be called the first face 522, and the face on the second direction side will be called the second face 523. The tubes 521 are open between the first face 522 and the second face 523.

Figure 5:
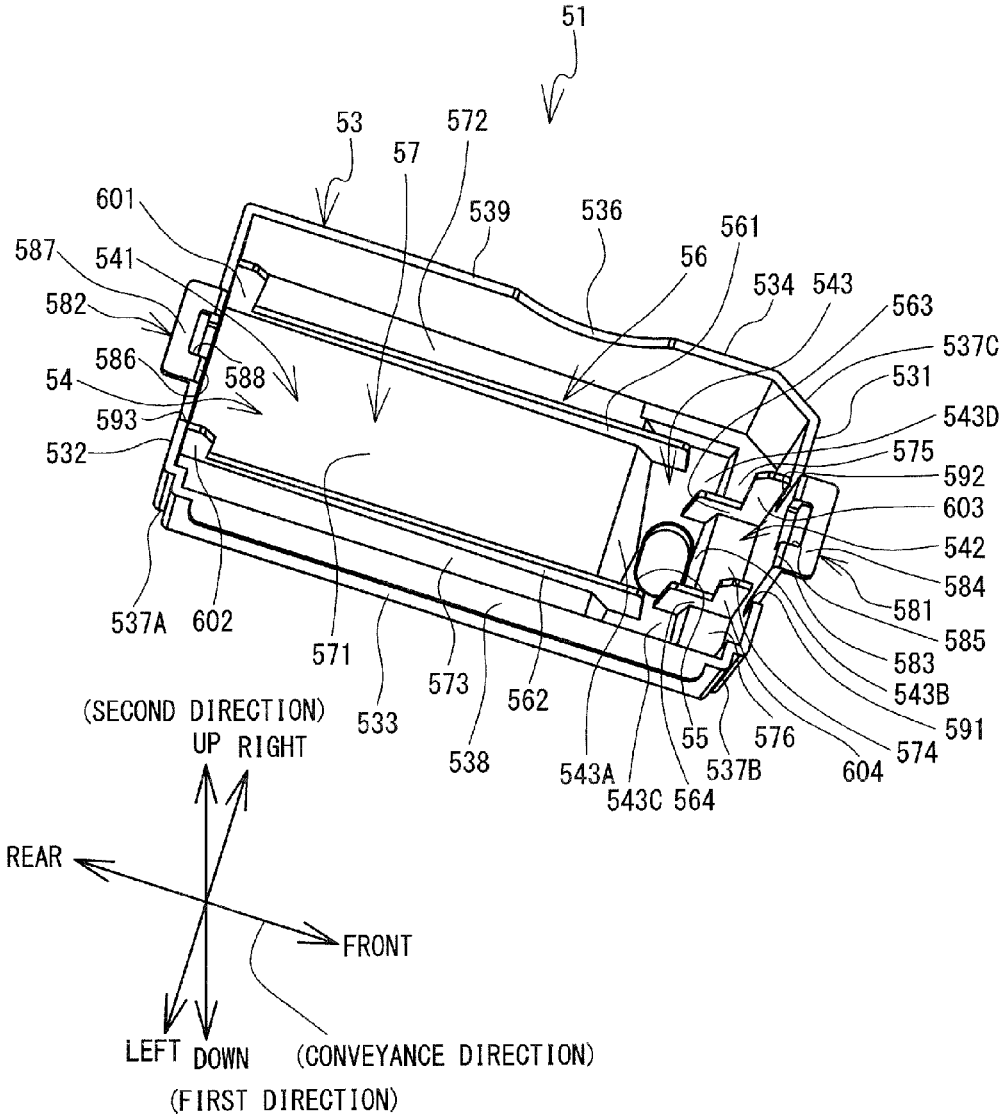
FIG. 5 is an oblique view of a receptacle.

As shown in FIG. 5, the receptacle 51 is provided with a perimeter wall portion 53, a bottom wall portion 54, a discharge outlet 55, a first attachment portion 581, and a second attachment portion 582. The perimeter wall portion 53 forms walls of the flushing unit 50 on the front, the rear, the left, and the right sides. The perimeter wall portion 53 has a rectangular in a plan view, with its long axis extending in the front-rear direction, and it extends in the second direction from the bottom wall portion 54, which will be described later. A cut-out 536, recessed portions 537A to 537D, and a projecting portion 538 are provided in the perimeter wall portion 53. The cut-out 536 is provided slightly toward the front from the center of a right wall portion 534 of the perimeter wall portion 53. The cut-out 536 is a location where the upper edge of the right wall portion 534 is curved downward in a circular arc shape.

Figure 6:
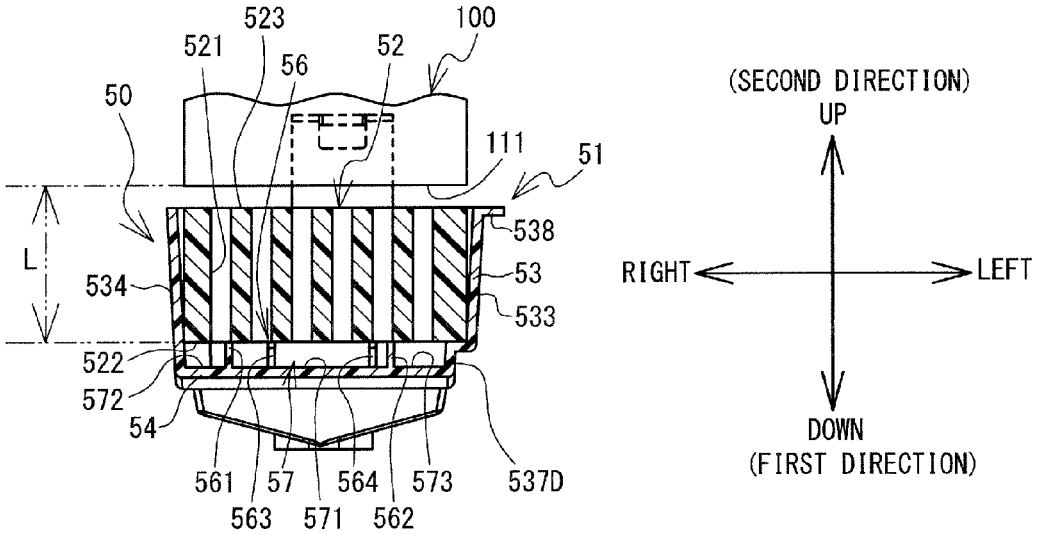
FIG. 6 is a section view along a line VI-VI in FIG. 3.

The recessed portion 537A is a location where the left rear part of the perimeter wall portion 53 is recessed toward the right front. The recessed portion 537B is a location where the left front part of the perimeter wall portion 53 is recessed toward the right rear. The recessed portion 537C is a location where the right front part of the perimeter wall portion 53 is recessed toward the left rear. The recessed portion 537C is formed by a wall portion that extends obliquely toward the left front. As shown in FIG. 6, the recessed portion 537D is a location where the lower part of a left wall portion 533 of the perimeter wall portion 53 is recessed toward the right. As shown in FIGS. 5 and 6, the projecting portion 538 is a location where the upper edge of the left wall portion 533 of the perimeter wall portion 53 projects toward the left.

As shown in FIG. 5, the bottom wall portion 54 is connected to the lower edge of the perimeter wall portion 53 and forms a bottom wall on first direction side of the flushing unit 50. The discharge outlet 55 is provided in the front part of the bottom wall portion 54. The discharge outlet 55 has a substantially oval shape in a bottom view, with its long axis extending in the left-right direction, and it is cylindrical in the first direction (refer to FIG. 4). The discharge outlet 55 is able to discharge ink to the outside of the receptacle 51. The ink that has been discharged from the discharge outlet 55 passes through a specified channel in the printer 1 and is accumulated in an ink collection portion or the like, for example, that is not shown in the drawings.

The bottom wall portion 54 is provided with an inclined face 541, a wall face 542, and a recessed portion 543. The recessed portion 543 is provided such that it extends in the left-right direction in the area around the discharge outlet 55. The recessed portion 543 is an area that is recessed lower than the inclined face 541 and the wall face 542, which will be described later. The recessed portion 543 includes wall faces 543A to 543D. The wall faces 543A, 543B, 543C, 543D respectively form a rear part, a front part, a left part, and a right part of the recessed portion 543, and they are inclined such that they are positioned closer to the first direction side as they extend closer to the discharge outlet 55. The wall face 543A is inclined downward toward the front. The wall face 543B is inclined downward toward the rear. The wall face 543C is inclined downward toward the right. The wall face 543D is inclined downward toward the left.

As shown in FIGS. 4 and 5, the inclined face 541 is a wall face between a rear wall portion 532 of the perimeter wall portion 53 and the recessed portion 543. The inclined face 541 is inclined such that it is positioned closer to the first direction side as it extends closer to the front side, where the discharge outlet 55 is provided. That is, the inclined face 541 is inclined in the first direction side as the inclined face 541 extends closer to the discharge outlet 55. The wall face 542 is a wall face between a front wall portion 531 of the perimeter wall portion 53 and the recessed portion 543. The wall face 542 is parallel to the front-rear direction.

As shown in FIG. 5, the receptacle 51 is provided with a first extended wall portion 561, a second extended wall portion 562, a third extended wall portion 563, and a fourth extended wall portion 564. In the explanation that follows, when the first extended wall portion 561, the second extended wall portion 562, the third extended wall portion 563, and the fourth extended wall portion 564 are referenced collectively, as well as when no one of them is specified, they will be called the extended wall portions 56. The extended wall portions 56 project in the second direction from the bottom wall portion 54 and extend toward the discharge outlet 55. The upper edges of the extended wall portions 56 are parallel to the front-rear direction and are positioned lower than an upper edge 539 of the perimeter wall portion 53.

The first extended wall portion 561 is provided in the right part of the inclined face 541 and extends along the inclined face 541 in the front-rear direction. The second extended wall portion 562 is provided in the left part of the inclined face 541 and extends along the inclined face 541 in the front-rear direction. The front edges of the first extended wall portion 561 and the second extended wall portion 562 are positioned in the center of the front-rear direction of the recessed portion 543. The rear edges of the first extended wall portion 561 and the second extended wall portion 562 are connected to projecting portions 601, 602, respectively. The projecting portion 601 is a portion that projects toward the front over the entire up-down direction of the right part of the rear wall portion 532 of the perimeter wall portion 53. The projecting portion 602 is a portion that projects toward the front over the entire up-down direction of the left part of the rear wall portion 532 of the perimeter wall portion 53. The first extended wall portion 561 and the projecting portion 601 are set apart from the right wall portion 534 of the perimeter wall portion 53. The second extended wall portion 562 and the projecting portion 602 are set apart from the left wall portion 533 of the perimeter wall portion 53.

The third extended wall portion 563 is provided in the right part of the wall face 542 and extends along the wall face 542 in the front-rear direction. The fourth extended wall portion 564 is provided in the left part of the wall face 542 and extends along the wall face 542 in the front-rear direction. The rear edges of the third extended wall portion 563 and the fourth extended wall portion 564 are positioned in the center of the front-rear direction of the recessed portion 543. The front edges of the third extended wall portion 563 and the fourth extended wall portion 564 are connected to projecting portions 603, 604, respectively. The projecting portion 603 is a portion that projects toward the rear over the entire up-down direction of the right part of the front wall portion 531. The projecting portion 604 is a portion that projects toward the rear over the entire up-down direction of the left part of the front wall portion 531. The third extended wall portion 563 and the projecting portion 603 are set apart from the right wall portion 534 of the perimeter wall portion 53. The position of the third extended wall portion 563 in the left-right direction is to the left of the position of the first extended wall portion 561 in the left-right direction. The fourth extended wall portion 564 and the projecting portion 604 are set apart from the left wall portion 533 of the perimeter wall portion 53. The position of the fourth extended wall portion 564 in the left-right direction is to the right of the position of the second extended wall portion 562 in the left-right direction.

The receptacle 51 is provided with a first discharge channel 571, a second discharge channel 572, a third discharge channel 573, a fourth discharge channel 574, a fifth discharge channel 575, and a sixth discharge channel 576. In the explanation that follows, when the first discharge channel 571, the second discharge channel 572, the third discharge channel 573, the fourth discharge channel 574, the fifth discharge channel 575, and the sixth discharge channel 576 are referenced collectively, as well as when no one of them is specified, they will be called the discharge channels 57. The discharge channels 57 are formed by the extended wall portions 56 and the bottom wall portion 54. The discharge channels 57 extend in the front-rear direction and are able to guide the ink toward the discharge outlet 55.

The first discharge channel 571 is formed by the first extended wall portion 561, the second extended wall portion 562, and the inclined face 541. The second discharge channel 572 is formed by the first extended wall portion 561, the right wall portion 534 of the perimeter wall portion 53, and the inclined face 541. The third discharge channel 573 is formed by the second extended wall portion 562, the left wall portion 533 of the perimeter wall portion 53, and the inclined face 541. The fourth discharge channel 574 is formed by the third extended wall portion 563, the fourth extended wall portion 564, and the wall face 542. The fifth discharge channel 575 is formed by the third extended wall portion 563, the right wall portion 534 of the perimeter wall portion 53, and the wall face 542. The sixth discharge channel 576 is formed by the fourth extended wall portion 564, the left wall portion 533 of the perimeter wall portion 53, and the wall face 542.

As shown in FIGS. 4 and 6, the edges on the second direction sides of the first to the fourth extended wall portions 561 to 564 are each set apart from the nozzle face 111 by the same distance L. The first face 522 and the second face 523 of the absorption member 52 are parallel to the nozzle face 111.

In the explanation that follows, the receptacle 51 in the maintenance portion 141 that is shown in FIG. 2 will sometimes be called the receptacle 51A, and the receptacle 51 in the maintenance portion 142 will sometimes be called the receptacle 51B. As shown in FIG. 2, the plurality of the receptacles 51A, 51B are arrayed in the conveyance direction. The extended wall portions 56 (refer to FIG. 5) extend in the conveyance direction. The positions of the discharge outlets 55 in the bottom wall portions 54 of the receptacles 51A, 51B are disposed in the same position in the conveyance direction. In other words, the plurality of the receptacles 51A, 51B are provided as common parts.

The mechanism by which the receptacle 51 is mounted in and removed from the printer 1 will be explained. As shown in FIGS. 3 and 5, the receptacle 51 is provided with the first attachment portion 581 and the second attachment portion 582. The first attachment portion 581 and the second attachment portion 582 are components for mounting the receptacle 51 in the printer 1. As shown in FIG. 3, slits 591, 592, which are set apart from one another in the left-right direction, are provided in the front wall portion 531 of the perimeter wall portion 53. The first attachment portion 581 is a component that extends from between the slits 591, 592, extending farther toward the second direction side than the upper edge 539 of the perimeter wall portion 53. The end on the second direction side of the first attachment portion 581 is an extending portion 584 that bends and extends toward the front at a bent portion 583. More specifically, as shown in FIGS. 3 and 5, the end on the second direction side of the first attachment portion 581 is provided with an opening 585 in a central portion of the left-right direction of the bent portion 583. The first attachment portion 581 is able to flex toward the front and the rear.

As shown in FIG. 3, slits 593, 594 (refer to FIG. 3), which are set apart from one another in the left-right direction, are provided in the rear wall portion 532 of the perimeter wall portion 53. The second attachment portion 582 is a component that extends from between the slits 593, 594, extending farther toward the second direction side than the upper edge 539 of the perimeter wall portion 53. The end on the second direction side of the second attachment portion 582 is an extending portion 587 that bends and extends toward the rear at a bent portion 586. More specifically, the end on the second direction side of the second attachment portion 582 is provided with an opening 588 in a central portion of the left-right direction of the bent portion 586. The second attachment portion 582 is able to flex toward the front and the rear.

Figure 7:
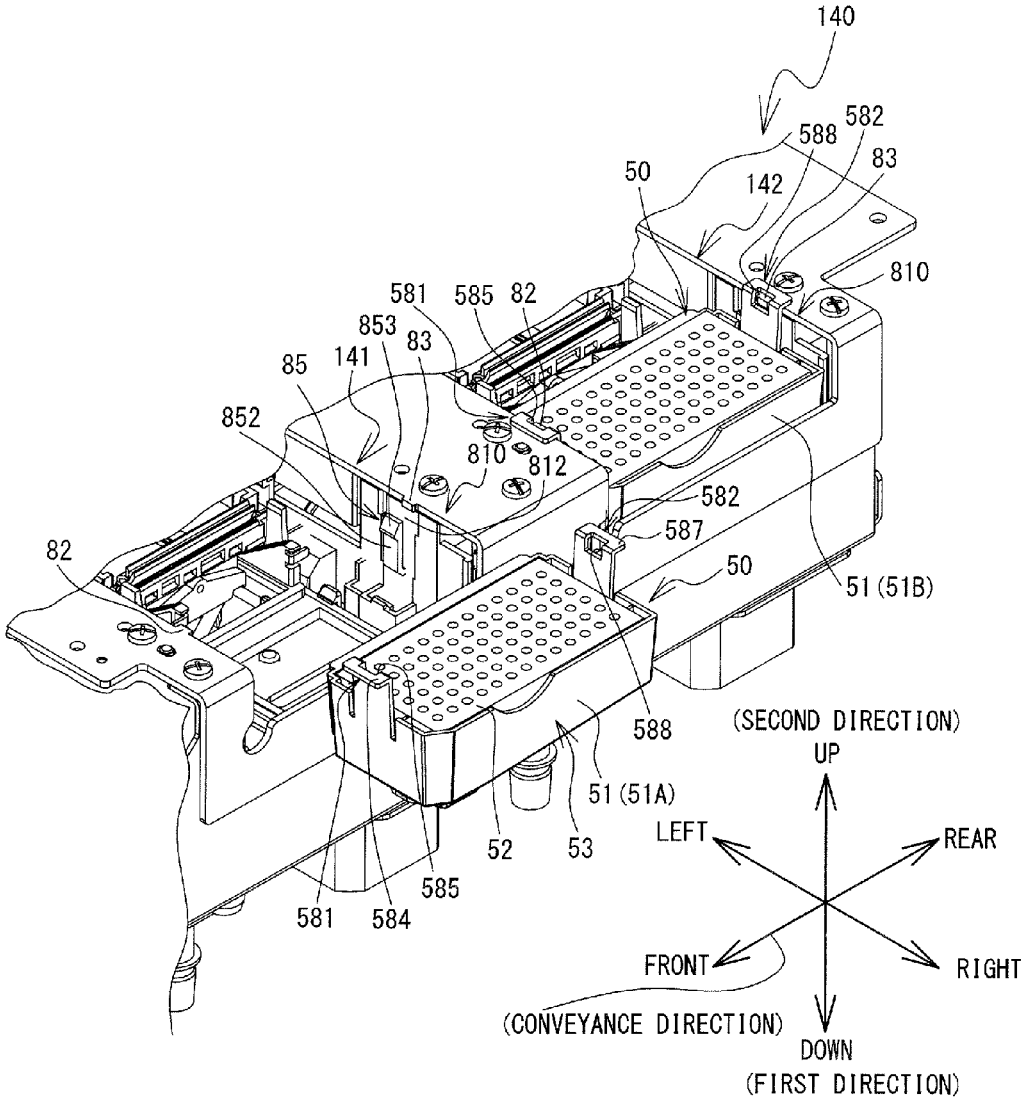
FIG. 7 is an enlarged view of a main portion of the non-printing area in a state in which the receptacle has been removed from a positioning portion.
Figure 8:
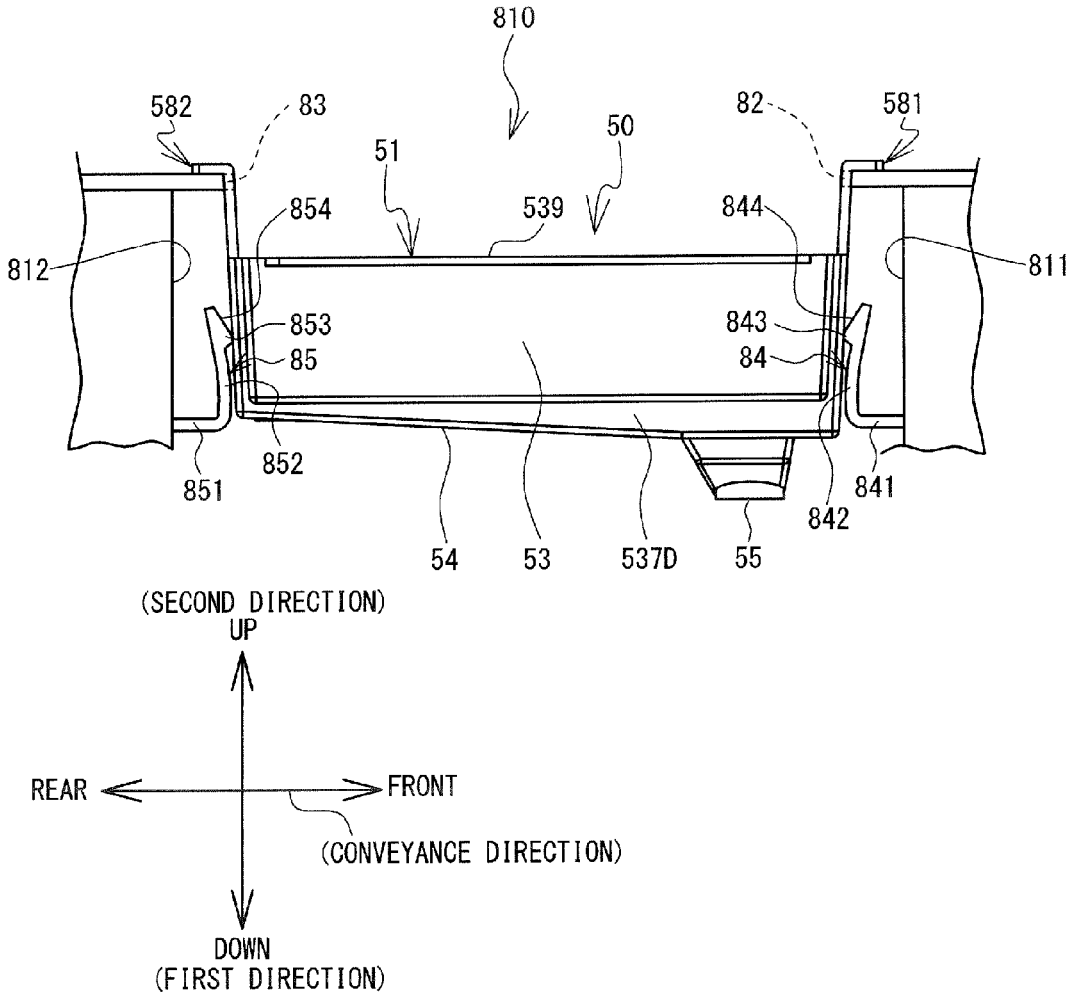
FIG. 8 is a left side view of the positioning portion in which the receptacle is disposed.

As shown in FIG. 7, the right edge portions of the maintenance portions 141, 142 of the printer 1 are positioning portions 810 in which the receptacles 51 are disposed. The positioning portions 810 are recessed toward the first direction side. As shown in FIGS. 7 and 8, each one of the positioning portions 810 is provided with a pair of projecting portions 82, 83 and a pair of contact portions 84, 85 (refer to FIG. 8). The projecting portion 82 is a location where a part of the upper edge at the front of the positioning portion 810 projects toward the rear. The projecting portion 83 is a location where a part of the upper edge at the rear of the positioning portion 810 projects toward the front.

The contact portion 84 is provided in the positioning portion 810 to the first direction side of the projecting portion 82. As shown in FIG. 8, the contact portion 84 is provided with a first section 841, a second section 842, and a projecting portion 843. The first section 841 projects toward the rear from a front wall 811 of the positioning portion 810. The second section 842 extends in the second direction from the rear end of the first section 841. The projecting portion 843 is a component that projects toward the rear from the second direction end of the second section 842. The upper rear portion of the projecting portion 843 is an inclined face 844 that slopes downward toward the rear. The contact portion 84 is able to flex toward the front and the rear.

The contact portion 85 is provided in the positioning portion 810 to the first direction side of the projecting portion 83. The contact portion 85 is provided with a first section 851, a second section 852, and a projecting portion 853. The first section 851 projects toward the front from a rear wall 812 of the positioning portion 810. The second section 852 extends in the second direction from the front end of the first section 851. The projecting portion 853 is a component that projects toward the front from the second direction end of the second section 852. The upper front portion of the projecting portion 853 is an inclined face 854 that slopes downward toward the front. The contact portion 85 is able to flex toward the front and the rear.

The way in which the receptacle 51 is mounted in the positioning portion 810 will be explained. Assume that the receptacle 51 has been removed from the positioning portion 810, as shown by the receptacle 51A in FIG. 7. The extending portions 584, 587 are gripped by the user, and the first attachment portion 581 and the second attachment portion 582 of the receptacle 51 that has been removed from the positioning portion 810 bend inward in the front-rear direction. As shown in FIG. 8, the receptacle 51 is disposed in the positioning portion 810. At this time, in the mounting process, the perimeter wall portion 53 of the receptacle 51 comes into contact with the inclined faces 844, 854 and presses the contact portions 84, 85 outward in the front-rear direction. The contact portions 84, 85 therefore bend outward in the front-rear direction. Once the receptacle 51 is disposed in the positioning portion 810, the user releases his grip on the extending portions 584, 587. The first attachment portion 581 and the second attachment portion 582, which had been bent, return to their unbent positions. The projecting portion 82 is inserted into the opening 585 of the first attachment portion 581 (refer to FIG. 7), and the projecting portion 83 is inserted into the opening 588 of the second attachment portion 582 (refer to FIG. 7). Therefore, the first attachment portion 581 and the second attachment portion 582 engage with the positioning portion 810. The projecting portions 843, 853 of the contact portions 84, 85 come into contact with the perimeter wall portion 53. The contact portions 84, 85 are pressed against the perimeter wall portion 53 by elastic forces.

The way in which the receptacle 51 is removed from the positioning portion 810 will be explained. The user grips the extending portions 584, 587, bending the first attachment portion 581 and the second attachment portion 582 of the receptacle 51 inward in the front-rear direction. The projecting portion 82 is thus released from its state of insertion in the opening 585 (refer to FIG. 7), and the projecting portion 83 is released from its state of insertion in the opening 588 (refer to FIG. 7). That is, the first attachment portion 581 and the second attachment portion 582 are disengaged from the positioning portion 810. The receptacle 51 is removed from the positioning portion 810 by being lifted upward. The contact portions 84, 85, which had been bent outward in the front-rear direction, return to their unbent positions.

The flushing operation will be explained. To perform the flushing operation, the CPU of the printer 1, which is not shown in the drawings, controls the heads 110 by executing a program that is stored in a storage portion. The CPU, by operating the drive motor 19 (refer to FIG. 1) to move the head units 100, 200 (refer to FIG. 1), moves the heads 110 to the second direction side of the flushing units 50, as shown in FIGS. 4 and 6. The printer 1 controls the heads 110 to discharge the ink toward the absorption members 52, which are disposed on the first direction side of the nozzle faces 111. In this manner, the flushing operation is performed.

The ink that is dropped onto the absorption members 52 by the flushing operation is moved in the first direction by the force of gravity. More specifically, the portion of the ink that is absorbed by the absorption members 52 is moved downward by the force of gravity. The ink drops into the discharge channels 57 from the second faces 523 of the absorption members 52 (refer to the arrow 931 in FIG. 4). The portion of the ink that passes through the insides of the tubes 521 is moved downward by the force of gravity and drops into the discharge channels 57 from the ends of the tubes 521 on the first direction side (refer to the arrow 932 in FIG. 4). The ink that has dropped into the discharge channels 57 moves through the discharge channels 57 toward the discharge outlets 55 (refer to the arrow 933 in FIG. 4). At this time, the ink in the first to the third discharge channels 571 to 573 (refer to FIG. 5) is moved along the inclined faces 541 by the action of the force of gravity (refer to the arrow 933 in FIG. 4). The ink moves along the wall faces 543A of the recessed portions 543 and is discharged to the outside of the receptacles 51 from the discharge outlets 55 (refer to the arrow 934 in FIG. 4).

The ink in the fourth to the sixth discharge channels 574 to 576 (refer to FIG. 5) is moved along the wall faces 542 (refer to the arrow 935 in FIG. 4). The wall faces 542 are disposed in the areas in the front parts of the bottom wall portions 54, so their surface areas are smaller than those of the inclined faces 541. Therefore, the ink tends to overflow the wall faces 542. Accordingly, the ink that overflows the wall faces 542 flows toward the discharge outlets 55 (refer to the arrow 935 in FIG. 4) and is discharged from the discharge outlets 55 via the wall faces 543B of the recessed portions 543 (refer to the arrow 936 in FIG. 4).

The printer 1 in the present embodiment is configured, and the flushing operation is performed, as described above. In the present embodiment, the extended wall portions 56 support the absorption member 52, so a space is formed between the absorption member 52 and the bottom wall portion 54, as shown in FIGS. 4 and 6. Accordingly, a liquid can drop from the absorption member 52 toward the bottom wall portion 54 (refer to the arrows 931, 932 in FIG. 4) more easily than would be the case if the absorption member 52 and the bottom wall portion 54 were in close contact, so the absorption member 52 is better able to discharge the ink. The tubes 521 of the absorption member 52 are open from the first face 522 through to the second face 523. Therefore, the ink that has been discharged from the absorption member 52 moves in the first direction within the tubes 521 more easily than would be the case if the tubes 521 appeared to be closed by the elasticity of the absorption member 52, for example. Accordingly, the ink readily passes through the insides of the tubes 521 and drops toward the bottom wall portion 54 (refer to the arrow 932 in FIG. 4), so the absorption member 52 is better able to discharge the ink. Moreover, the ink that has dropped onto the bottom wall portion 54 is guided toward the discharge outlet 55 by the discharge channels 57 and is discharged from the discharge outlet 55. Accordingly, the ink is discharged from the receptacle 51 more readily than would be the case if the discharge channels 57 were not provided. Because the ink is discharged from the absorption member 52 and the receptacle 51 more readily, the amount of the ink that remains in the absorption member 52 is reduced, making it less likely that the ink will harden and bind to the absorption member 52. The ability of the absorption member 52 to absorb the ink is thus improved. The frequency with which the absorption member 52 is replaced can be reduced accordingly.

Even if the ink were to harden and bind to the surface of the absorption member 52, making it harder for the absorption member 52 to absorb the ink, the ink would still pass through the tubes 521 and flow through the discharge channels 57 (refer to the arrow 932 in FIG. 4). Therefore, the ink can still be discharged smoothly to the outside of the receptacle 51 by flowing from the tubes 521 to the discharge channels 57 and the discharge outlet 55.

The bottom wall portion 54 is provided with the inclined face 541. Therefore, the ink moves more easily along the inclined face 541 of the bottom wall portion 54 (refer to the arrow 933 in FIG. 4) than would be the case if the inclined face 541 were not provided, so the ink is discharged more easily. The possibility is thus reduced that the ink that has dropped onto the bottom wall portion 54 will be reabsorbed by the absorption member 52, making it less likely that the ink will harden and bind to the absorption member 52. The absorbency of the absorption member 52 is thus improved. The frequency with which the absorption member 52 is replaced can be reduced accordingly.

The edges on the second direction sides of the first to the fourth extended wall portions 561 to 564, which are the plurality of the extended wall portions 56, are each set apart from the nozzle face 111 by the same distance L. The first face 522 and the second face 523 are parallel to the nozzle face 111. The distances between the nozzle face 111 and the edges on the second direction sides of each one of the plurality of the extended wall portions 56 are each the same distance L, regardless of the shape of the bottom wall portion 54. Therefore, by supporting the first face 522, the extended wall portions 56 are able to maintain the second face 523 in a position that is parallel to the nozzle face 111. For example, in a case where the second face 523 is inclined in relation to the nozzle face 111, there would be places where the nozzle face 111 and the second face 523 are close to one another and places where they are farther apart. That would create the possibility that, where the nozzle face 111 and the second face 523 are close to one another, for example, the nozzle face 111 would come into contact with the ink that is adhering to the absorption member 52. The possibility would also be created that where the nozzle face 111 and the second face 523 are farther apart, the ink that is discharged from the nozzle face 111 would form a mist before it reached the absorption member 52. In the present embodiment, the nozzle face 111 and the second face 523 are parallel to one another, so the distance between the nozzle face 111 and the second face 523 is constant. That reduces the possibility that the nozzle face 111 will come into contact with the ink that is adhering to the absorption member 52 or that the liquid that is discharged from the nozzle face 111 will form a mist. Accordingly, the possibility that the ink that is adhering to the absorption member 52 will adhere to the nozzle face 111 and clog the nozzles can be reduced. The possibility that the ink that has formed a mist will not drop into the receptacle 51 and be discharged from the receptacle 51 can also be reduced.

As shown in FIGS. 1 and 7, the plurality of the receptacles 51A, 51B are provided as common parts. The positions of the discharge outlets 55 in the bottom wall portions 54 of the receptacles 51A, 51B are disposed in the same position in the conveyance direction. Therefore, the plurality of the receptacles 51A, 51B are both disposed in the same orientation. Accordingly, the user can grip the receptacles 51A, 51B in their mounting orientations more easily than would be the case if the orientations of the plurality of the receptacles 51A, 51B were different. The operability of the receptacles 51A, 51B for mounting and removing is thus improved, as is their operability for mounting the absorption members 52 in the receptacles 51. Therefore, the possibility that the receptacles 51A, 51B and the absorption members 52 will be mounted incorrectly can be reduced, making it possible to ensure that the ink will be absorbed and discharged properly.

The ink contains a resin emulsion. In a case where a resin emulsion is included in the ink, the viscosity of the ink is sometimes greater than it is in a case where a resin emulsion is not included. However, in the present embodiment, the ability of the printer 1 to discharge the ink is excellent, so even an ink with greater viscosity can be discharged easily. Accordingly, the ability of the absorption member 52 and the receptacle 51 to absorb and discharge the ink can be ensured, and the frequency of replacement for the absorption member 52 can be reduced.

As shown in FIGS. 7 and 8, the projecting portion 82 is inserted into the opening 585 of the first attachment portion 581, and the projecting portion 83 is inserted into the opening 588 of the second attachment portion 582. The first attachment portion 581 and the second attachment portion 582 thus engage with the positioning portion 810. Furthermore, as shown in FIG. 8, the contact portions 84, 85 are pressed against the perimeter wall portion 53 by elastic forces. Therefore, the possibility that the receptacle 51 will wobble in relation to the positioning portion 810 can be reduced from what it would be in a case where the perimeter wall portion 53 is not pressed by the contact portions 84, 85. Accordingly, the ink is discharged from the absorption member 52 more reliably, and the ink can be discharged through the discharge channels 57.

Note that the present disclosure is not limited to the embodiment that is described above, and various types of modifications can be made. For example, the two contact portions 84, 85 are provided in the positioning portion 810, as shown in FIG. 8, but it is also acceptable for only one of the contact portions to be provided. It is also acceptable for the contact portions 84, 85 not to be provided. The two openings 585, 588 are provided, but it is also acceptable for only one of the openings to be provided. The two projecting portions 82, 83 are provided, but it is also acceptable for only one of the projecting portions to be provided. It is also acceptable for the openings 585, 588 and the projecting portions 82, 83 not to be provided. The receptacle 51 can be mounted in and removed from the positioning portion 810, but it is also acceptable for the receptacle 51 to be affixed to the positioning portion 810, such that it cannot be mounted in and removed from the positioning portion 810. The numbers of the receptacles 51 and the heads 110 are not limited, and it is also acceptable for more than two of the receptacles 51 and the heads 110 to be provided and for only one of each to be provided.

The plurality of the receptacles 51A, 51B may also be arrayed in a direction that is different from the conveyance direction. The plurality of the extended wall portions 56 extend in the conveyance direction, as shown in FIG. 5, but they may also extend in directions that are different from the conveyance direction. The edges on the second direction sides of the plurality of the extended wall portions 56 are each set apart from the nozzle face 111 by the same distance L, as shown in FIGS. 4 and 6, but each of the distances may also be a different distance. The first face 522 and the second face 523 of the absorption member 52 are parallel to the nozzle face 111, but it is also acceptable for them not to be parallel. The inclined face 541 of the bottom wall portion 54 is inclined such that it is positioned closer to the first direction side as it extends closer to the discharge outlet 55, but it may also be parallel to the front-rear direction. The recessed portion 543 is provided, but it is also acceptable for it not to be provided. The resin emulsion is included in the ink, but it is also acceptable for it not to be included. The liquid that is discharged from the nozzle face 111 is not limited to being an ink, it may also be a discharge agent that decolorizes a dyed cloth, a processing agent that makes the ink adhere better to the cloth, or the like.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printing device comprising:

a head portion including a nozzle face, the nozzle face having a nozzle to discharge a liquid;

a receptacle portion provided facing the nozzle face;

an absorption member supported by the receptacle portion, the absorption member provided facing the nozzle face and provided to absorb the liquid, the absorption member being provided with a through-hole, the through-hole extending through the absorption member, in an orthogonal direction to the nozzle face, between a first face and a second face of the absorption member, the first face being an opposite side to the second face, the second face facing the nozzle face in the orthogonal direction, a discharge outlet provided in a bottom wall portion of the receptacle portion, the bottom wall portion extending along the nozzle face, the discharge outlet being continuous with an outside of the receptacle portion a perimeter wall portion provided in the receptacle portion, the perimeter wall portion extending from the perimeter of the bottom wall portion to the nozzle face side;

a plurality of projecting portions projecting inward from the perimeter wall portion and setting the absorption member apart from the perimeter wall portion;

a plurality of extended wall portions projecting from the bottom wall portion to the nozzle face side and supporting the first face of the absorption member; and wherein the bottom wall portion is provided with an inclined face inclined in an opposite direction to the nozzle face side as the inclined face.

2. The printing device according to claim 1, wherein the plurality of extended wall portions extend toward the discharge outlet.

3. The printing device according to claim 1, wherein the distances between the nozzle face and each edge of the plurality of the extended wall portions on the nozzle face sides are all the same distance, and the first face and the second face are parallel to the nozzle face.

4. The printing device according to claim 1, further comprising:

a conveyance portion provided to convey a print medium, wherein a plurality of the head portions are arrayed in a conveyance direction in which the conveyance portion conveys the print medium, a plurality of the receptacle portions are arrayed in the conveyance direction, the plurality of the extended wall portions extend in the conveyance direction, and the positions of the discharge outlets in the bottom wall portions of the plurality of the receptacle portion are disposed in the same position in the conveyance direction.

5. The printing device according to claim 2, wherein, the head portion is provided to move in a main scanning direction, the plurality of extended wall portions extend along a sub scanning direction, the sub scanning direction is orthogonal to the main scanning direction.

6. The printing device according to claim 5, wherein the perimeter wall portion includes a first wall portion and a second wall portion, the first wall portion is provided on one side of the extended wall portions in the sub scanning direction and the second wall portion is provided on another side of the extended wall portions in the sub scanning direction.

7. The printing device according to claim 6, wherein the plurality of projecting portions include a first projecting portion, the first projecting portion projects from the first wall portion in the sub scanning direction.

8. The printing device according to claim 7, wherein the plurality of extended wall portions include a first extended wall portion, the first extended wall portion extends in the sub scanning direction from the first projecting portion toward the discharge outlet in the sub scanning direction.

9. The printing device according to claim 8, wherein a leading edge of the first projecting portion comes into contact with a side surface on the first wall portion side of the absorption member, and the first projecting portion sets the absorption member apart from the first wall portion in the sub scanning direction.

10. The printing device according to claim 6, wherein the discharge outlet is positioned closer to the second wall portion than the first wall portion.

11. The printing device according to claim 8, wherein the plurality of projecting portions include a second projecting portion, the second projecting portion projects from the second wall portion in the sub scanning direction.

12. The printing device according to claim 11, wherein the plurality of extended wall portions include a second extended wall portion, the second extended wall portion extends in the sub scanning direction from the second projecting portion toward the discharge outlet in the sub scanning direction.

13. The printing device according to claim 12, wherein a leading edge of the second projecting portion comes into contact with a side surface on the second wall portion side of the absorption member, and the second projecting portion sets the absorption member apart from the second wall portion in the sub scanning direction.

14. The printing device according to claim 12, wherein the first extended wall portion is positioned in a position other than a position of the second extended wall portion in the main scanning direction.

15. The printing device according to claim 14, wherein the second extended wall portion is positioned closer to the discharge outlet than the first extended wall portion in the main scanning direction.

16. The printing device according to claim 5, wherein the plurality of extended wall portions are set apart from a wall, extending in the sub scanning direction of the perimeter wall portion.

17. The printing device according to claim 1, further comprising:

an attachment portion provided on the perimeter wall portion, the attachment portion attached to the printing device and engaged with an engagement portion provided in the printing device; and a pressing portion provided in an opposite direction to the nozzle face side with respect to the engagement portion and pressing the perimeter wall portion by elastic force.

18. The printing device according to claim 17, wherein the attachment portion projects from the perimeter wall portion to the nozzle face side, is flexible, and is provided with an opening, and the engagement portion is provided in a positioning portion in which the receptacle portion is disposed and is provided with a projecting portion, the projecting portion is inserted into the opening of the attachment portion.

19. The printing device according to claim 1, wherein the liquid contains a resin emulsion.

* * * * *